US009951496B2

(12) United States Patent
Vaughan

(10) Patent No.: US 9,951,496 B2
(45) Date of Patent: Apr. 24, 2018

(54) SYSTEMS AND METHODS FOR HARVESTING NATURAL GAS FROM UNDERWATER CLATHRATE HYDRATE DEPOSITS

(76) Inventor: Susanne F. Vaughan, Austin, TX (US)

( * ) Notice: Subject to any disclaimer, the term of this patent is extended or adjusted under 35 U.S.C. 154(b) by 341 days.

(21) Appl. No.: 13/051,919

(22) Filed: Mar. 18, 2011

(65) Prior Publication Data

US 2012/0234552 A1 Sep. 20, 2012

(51) Int. Cl.

| | |
|---|---|
| ***E02F 3/92*** | (2006.01) |
| ***E02F 3/88*** | (2006.01) |
| ***E02F 7/00*** | (2006.01) |
| ***E02F 3/90*** | (2006.01) |
| ***E02F 7/06*** | (2006.01) |
| ***E21C 50/00*** | (2006.01) |
| *E21B 43/01* | (2006.01) |

(52) U.S. Cl.

CPC ..... *E02F 7/005* (2013.01); *E02F 3/8866* (2013.01); *E02F 3/907* (2013.01); *E02F 3/9212* (2013.01); *E02F 3/9225* (2013.01); *E02F 7/06* (2013.01); *E21C 50/00* (2013.01); *E21B 2043/0115* (2013.01)

(58) Field of Classification Search

CPC .. E21C 50/00; E02F 7/005; E02F 3/92; E02F 3/88; E02F 3/9268; E02F 3/94; E02F 3/8858; E21B 43/36

USPC ..... 166/352, 357, 358, 367, 267, 75.12; 37/307, 313, 314, 343; 299/8, 9

See application file for complete search history.

(56) References Cited

U.S. PATENT DOCUMENTS

| | | | | | |
|---|---|---|---|---|---|
| 19,908 | A * | 4/1858 | Bishop | E02F 5/282 | 37/343 |
| 227,988 | A * | 5/1880 | Meech | E02F 3/88 | 198/509 |
| 328,095 | A * | 10/1885 | Walsh | E02F 3/905 | 37/313 |
| 360,713 | A * | 4/1887 | Mendenhall | E02F 3/081 | 299/9 |
| 539,463 | A * | 5/1895 | Whaler | E02F 3/88 | 209/497 |
| 557,178 | A * | 3/1896 | Wood | E02F 3/9231 | 209/250 |
| 590,392 | A * | 9/1897 | Emerson | E02F 3/925 | 37/313 |
| 657,247 | A * | 9/1900 | McDougall | E21C 41/26 | 299/17 |
| 660,956 | A * | 10/1900 | Henderson | E02F 3/9237 | 37/329 |
| 814,019 | A * | 3/1906 | Clark | E02F 3/92 | 37/314 |
| 842,383 | A * | 1/1907 | Clark | E02F 3/90 | 37/314 |

(Continued)

*Primary Examiner* — Matthew R Buck
*Assistant Examiner* — Edwin J Toledo-Duran
(74) *Attorney, Agent, or Firm* — Cesari & Reed, LLP; Ronald M. Reed

(57) ABSTRACT

A system for harvesting natural gas from a clathrate deposit includes a storage system and a processing system. The storage system is located at a surface of a body of water and is configurable to couple to a conduit for receiving a slurry including clathrate hydrate pieces and natural gas from an underwater apparatus. The processing system is coupled to the conduit and is configured to separate the natural gas from the slurry.

19 Claims, 7 Drawing Sheets

(56) References Cited

U.S. PATENT DOCUMENTS 1,097,722 A * 5/1914 Lake ..... E02F 3/8858 299/9
1,170,581 A * 2/1916 Walker ..... E02F 3/92 299/9
1,270,142 A * 6/1918 Gage ..... E02F 3/88 209/458
1,462,196 A * 7/1923 Dros ..... A01K 79/00 37/314
1,697,368 A * 1/1929 Ream ..... E02F 3/401 37/314
1,765,041 A * 6/1930 Waters ..... E02F 5/282 37/343
1,963,996 A * 6/1934 Lake ..... B63C 11/38 37/313
2,545,739 A * 3/1951 Martin ..... E02F 3/6463 172/448
3,063,507 A * 11/1962 O'Neill ..... E21B 7/12 114/264
3,160,966 A * 12/1964 Skakel ..... E02F 3/9237 37/313
3,171,219 A * 3/1965 Kaufmann ..... E02F 3/8808 175/5
3,248,812 A * 5/1966 Gardner ..... E02F 3/88 15/1.7
3,314,174 A * 4/1967 Haggard ..... E02F 3/081 37/313
3,429,062 A * 2/1969 Nelson ..... E02F 3/88 37/310
3,433,531 A * 3/1969 Koot ..... E02F 3/8858 299/8
3,462,858 A * 8/1969 Francklyn ..... A01K 80/00 299/8
3,540,194 A * 11/1970 Chaplin ..... A01D 44/00 299/9
3,588,174 A * 6/1971 Rossfelder ..... E02F 3/88 299/8
3,629,963 A * 12/1971 Itami ..... B22F 3/00 172/812
3,638,338 A * 2/1972 Nelson ..... E02F 3/907 114/144 B
3,672,725 A * 6/1972 Johnson ..... E02F 3/8858 299/8
3,697,134 A * 10/1972 Murray ..... E02F 3/88 299/8
3,748,248 A * 7/1973 Wanzenberg ..... E21C 50/00 204/208
3,829,160 A * 8/1974 Condolios ..... E02F 3/9212 299/8
3,905,137 A * 9/1975 Gee ..... E02F 3/8858 180/68.1
3,950,030 A * 4/1976 Girden ..... E02F 3/92 209/458
3,972,566 A * 8/1976 Brockett, III ..... E02F 3/9212 209/17
3,975,054 A * 8/1976 Brockett, III ..... E02F 3/92 299/8
3,975,842 A * 8/1976 Andreae ..... E02F 3/9212 37/322
3,999,313 A * 12/1976 Andrews ..... E02F 3/081 299/8
4,010,560 A * 3/1977 Diggs ..... E02F 3/082 299/9
4,018,280 A * 4/1977 Daviduk ..... E21B 43/24 166/266
4,035,022 A * 7/1977 Hahlbrock ..... E02F 5/006 299/8
4,053,181 A * 10/1977 Saito ..... E02F 3/88 299/9
4,147,390 A * 4/1979 Deliege ..... E02F 3/92 299/8
4,150,502 A * 4/1979 Sijthoff ..... E02L 33/02 37/333
4,204,347 A * 5/1980 Wolters ..... E02F 3/8858 37/310
4,232,903 A * 11/1980 Welling ..... E02F 3/8858 299/8
4,280,288 A * 7/1981 Corfa ..... E02F 5/006 37/308
4,311,342 A * 1/1982 Latimer ..... E02F 3/9237 299/8
4,376,462 A 3/1983 Elliott et al.
4,391,468 A * 7/1983 Funk ..... E02F 3/90 299/8
4,778,219 A * 10/1988 Wilczynski ..... B03B 5/18 209/425
5,217,076 A * 6/1993 Masek ..... E21B 43/24 166/245
5,353,529 A * 10/1994 McCullough ..... E02F 5/223 172/43
5,950,732 A * 9/1999 Agee ..... C10G 2/30 166/248
5,964,093 A 10/1999 Heinemann et al.
5,970,635 A * 10/1999 Wilmoth ..... E02B 3/023 37/323
6,082,118 A 7/2000 Endrizzi et al.
6,178,670 B1 * 1/2001 Susman ..... E02F 3/8858 175/107
6,192,691 B1 2/2001 Nohmura
6,209,965 B1 * 4/2001 Borns ..... E02F 3/925 299/17
6,245,955 B1 6/2001 Smith
6,299,256 B1 * 10/2001 Wyatt ..... E21B 43/006 299/8
6,550,162 B2 * 4/2003 Price ..... E02F 3/8858 37/317
6,703,534 B2 3/2004 Waycuilis et al.
6,817,427 B2 11/2004 Matsuo et al.
6,978,837 B2 12/2005 Yemington
7,165,621 B2 1/2007 Ayoub et al.
7,222,673 B2 5/2007 Graue et al.
7,395,618 B2 * 7/2008 Jacobsen ..... E02F 3/9262 37/313
8,091,255 B2 * 1/2012 Drabble ..... E02F 3/8841 37/307
8,122,618 B2 * 2/2012 Van Rompay ..... E02F 3/88 37/195
8,522,459 B2 * 9/2013 Pavan ..... E02F 3/902 37/320
8,623,107 B2 * 1/2014 McAlister ..... C01B 3/24 166/352
8,678,514 B2 * 3/2014 Efthymiou ..... E02F 3/8866 299/8
2005/0072301 A1 * 4/2005 Baciu ..... B01D 53/002 95/258
2012/0181041 A1 * 7/2012 Willman ..... E02F 3/925 166/357

* cited by examiner

SYSTEMS AND METHODS FOR HARVESTING NATURAL GAS FROM UNDERWATER CLATHRATE HYDRATE DEPOSITS

FIELD

The present disclosure is generally related to clathrate recovery systems and methods, and more particularly to systems and methods of recovering clathrate from underwater deposits for harvesting trapped natural gas.

BACKGROUND

Methane clathrate (also called methane hydrate, hydromethane, methane ice or "fire ice") comprises a solid clathrate compound (more specifically, a clathrate hydrate) in which a large amount of methane is trapped within a crystal structure of water, forming a solid similar to ice. Within methane clathrate deposits, the small non-polar molecules (typically gases) are trapped inside "cages" of hydrogen-bonded water molecules. In other words, clathrate hydrates are clathrate compounds in which the host molecule is water and the guest molecule is typically a gas. Since the trapped molecules do not bond to the lattice, the clathrate hydrates are not chemical compounds, and the formation and decomposition of clathrate hydrates are first-order phase transitions and not chemical reactions.

Methane clathrates occur at under water depths of less than 2000 meters, for example adjacent to polar continental sedimentary rocks where surface temperatures are less than 0° C. and in oceanic sediment at water depths greater than 300 m where the water temperature is around 2° C. In addition, deep lakes may host gas hydrates as well. Continental deposits have been located in Siberia and Alaska in sandstone and siltstone beds at less than 800 m depth. Further, oceanic deposits seem to be widespread in the continental shelf and can occur within the sediments at depth or close to the sediment-water interface. Additionally, methane clathrate deposits may cap even larger deposits of gaseous methane.

Methane hydrates sometimes form from methane gas released as byproduct of deep sea drilling or from release of methane gas along oceanic geological faults. In some regions (e.g., the Gulf of Mexico), methane in clathrates may be at least partially derived from thermal degradation of organic matter. When released, the methane gas floats upward toward the surface of the water. In warm waters, the methane gas may be released into the atmosphere. In colder climates and at deep sea levels or in deep lakes, at least a portion of the methane gas crystallizes on contact with cold water. The crystallized methane gas flows with deep water currents, eventually settling in deposits. Such deposits often exist in the ocean near the continental shelves.

The worldwide amounts of methane bound in clathrate hydrates is conservatively estimated to total twice the amount of methane to be found in all known fossil fuels on Earth. Testing of such deposits indicates that the average methane clathrate hydrate composition includes one mole of methane for every 5.75 moles of water. The average observed density has been around 0.9 grams per cubic centimeter. Based on these averages, a typical liter of methane clathrate solid would contain approximately 168 liters of methane gas (at STP).

SUMMARY

In an embodiment, a system for harvesting natural gas from a clathrate deposit includes a storage system and a processing system. The storage system is located at a surface of a body of water and is configurable to couple to a conduit for receiving a slurry including clathrate hydrate pieces and natural gas from an underwater apparatus. The processing system is coupled to the conduit and is configured to separate the natural gas from the slurry.

In another embodiment, a harvesting unit includes a plow unit having a propulsion system and configured to move along an underwater surface according to control signals from a remote controller. The harvesting unit further includes a harrow coupled to the plow unit and configured to couple to a conduit. The harrow is configured to mechanically break portions of a clathrate deposit into a slurry and to direct the slurry into the conduit.

In still another embodiment, a method of harvesting natural gas from clathrate hydrate deposits on an underwater surface includes mechanically fracturing and dislodging selected portions of a clathrate hydrate deposit from the underwater surface using a mobile harvesting unit coupled to a conduit. The method further includes directing the selected portions into the conduit as a slurry and processing the slurry to separate natural gas from other components.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

While it is estimated that sedimentary methane hydrate reservoir probably contains two to ten times the currently known reserves of conventional natural gas, little has been done to harvest these deposits. A number of factors may contribute to the lack of progress. First, it has traditionally been difficult to locate substantial methane clathrate deposits, because they are deep under water. Second, traditional extraction technologies are too expensive to economically harvest methane from clathrate deposits that may be distributed across large areas of the sea floor.

Embodiments of systems and methods for methane clathrate extraction are described below, which utilize a mobile harvesting unit together with mobile methane processing, storage, and distribution systems. The system uses a "Bottom Simulating Reflector" (BSR), which is a seismic reflection of the sediment-to-clathrate stability zone interface, to detect methane clathrate deposits. Unequal densities of normal sediments and those laced with clathrates produce seismic reflections making detection of the methane clathrate deposits possible. Upon detection of the methane clathrate deposit, the system deploys a mobile harvesting unit that is configured to move along the ocean floor (using wheels, tracks, or other means) to traverse the ocean floor. The mobile harvesting unit includes a plow to break the clathrate into pieces forming a slurry and a pressurized conduit configured to capture the slurry and any released methane and to direct the slurry and the methane to the surface of the water.

The system further includes a storage tanker coupled to the conduit and configured to process the methane gas into a pressurized storage tank. The storage tanker further includes one or more distribution mechanisms configurable to couple to delivery tankers, which load methane gas from the storage tanker and deliver the methane gas to a destination. An example of one possible embodiment of such a system is described below with respect to FIG. 1.

Figure 1:
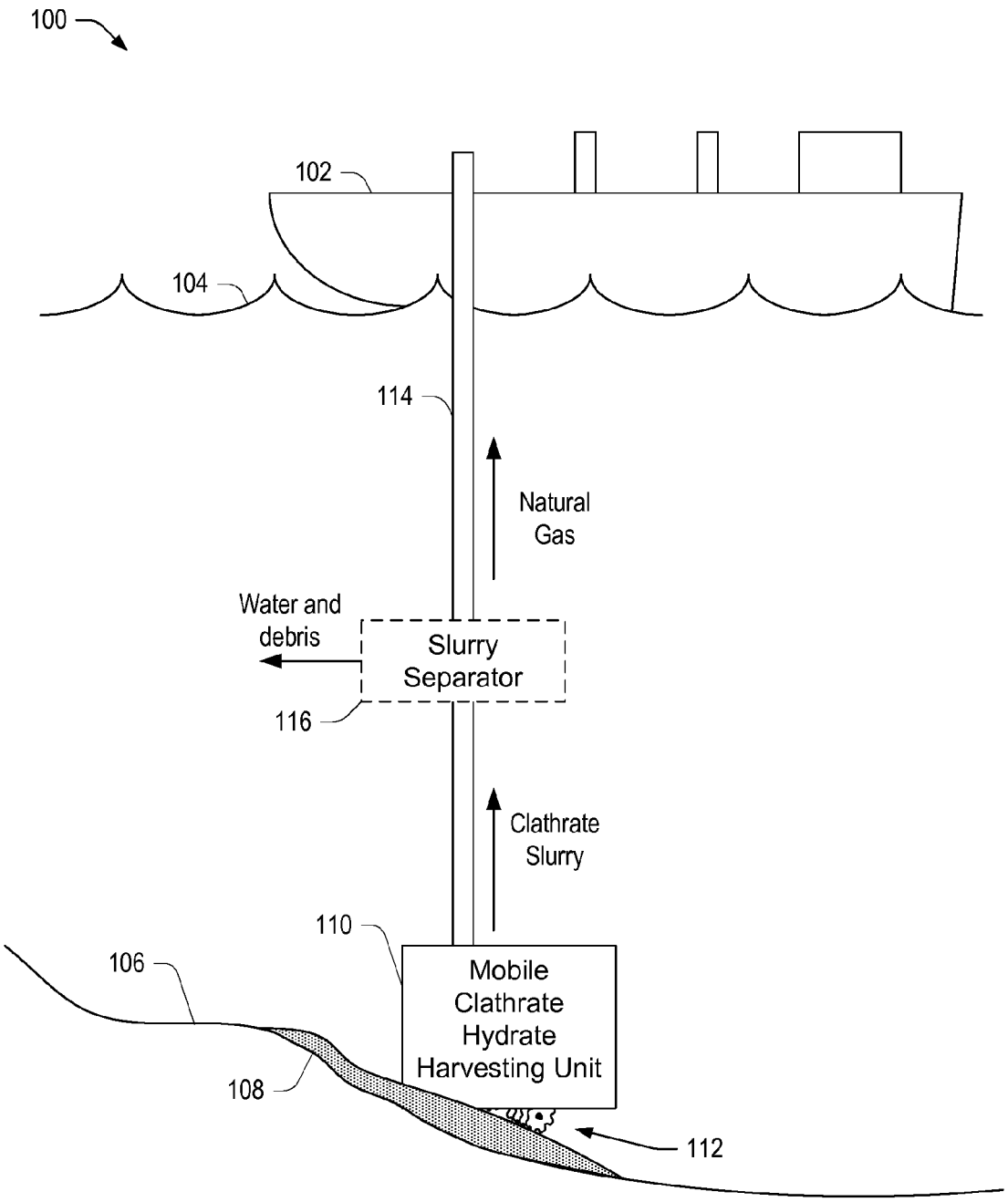
FIG. 1 is a block diagram of an embodiment of a system for recovering clathrate including a clathrate hydrate harvesting unit and a process ship.

FIG. 1 is a block diagram of an embodiment of a system 100 for recovering methane clathrate including a mobile/portable harvesting unit 110 and a process ship 102. Process ship 102 is at the surface 104 of a body of water. Harvesting unit 110 is deployed at an underwater surface 106 that includes a clathrate deposit 108 and is coupled to process ship 102 by a conduit 114. Conduit 114 may be pressurized to draw fluid, clathrate, methane and debris toward surface 104. Harvesting unit 110 includes one or more blades 112 configured to break the clathrate into pieces, forming a slurry that is drawn into conduit 114.

System 100 further includes a slurry separator 116, which is shown in phantom, because it may be included within harvesting unit 110, within process ship 102, or at one or more locations along conduit 114. Slurry separator 116 may include a centrifuge, filters, mixers, other components, or any combination thereof, which can cooperate to separate methane gas from the slurry. Slurry separator 116 dispels water, ice and debris, allowing the methane gas to proceed to process ship 102 through conduit 114.

Conduit 114 may be formed from any material suitable for use in deep water. In some instances, conduit 114 may be formed from a substantially flexible tubing material and may include hoops or rings at the end coupled to harvesting unit 110 to allow for a vacuum-type of draw of the slurry into the conduit 114 without collapsing under the pressure from the water.

In an example, harvesting unit 110 is controlled by systems within process ship 102 to traverse the underwater surface 106 and to carve or plow portions of the clathrate deposit 108, breaking ice cages to release trapped methane and breaking the clathrate deposit 108 into small pieces that can be drawn into conduit 114 as a slurry. Pressure applied to conduit 114 by process ship 102 draws the slurry and methane gas toward surface 104. Slurry separate 116 operates on the slurry to separate the methane gas from the ice and debris, releasing the methane, which rises to surface 104 within conduit 114. Process ship 102 receives the methane gas and pressurizes the gas for storage. Process ship 102 also includes a mechanism for distributing the methane gas to transport vehicles for delivery to a destination.

Figure 2:
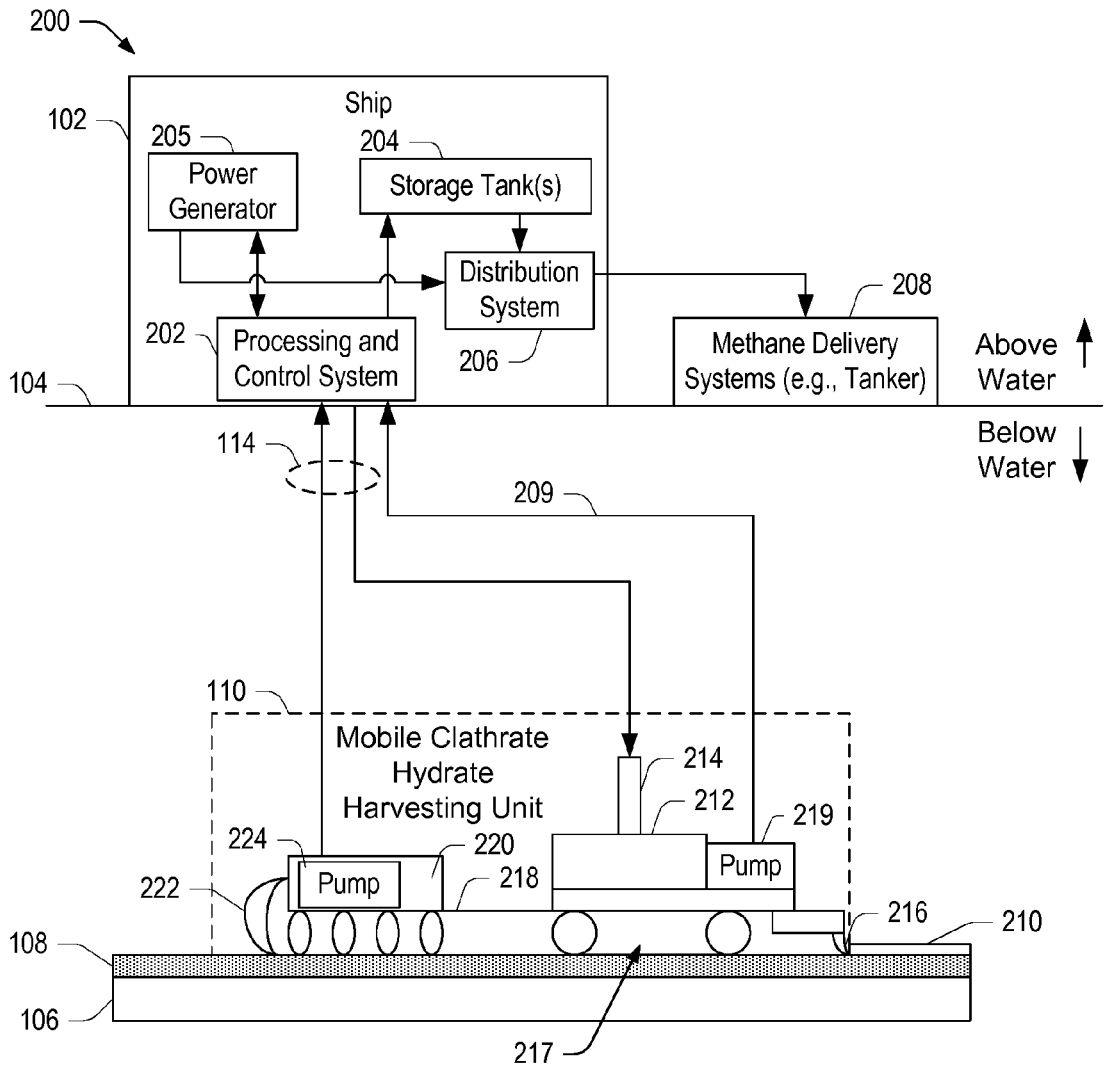
FIG. 2 is a block diagram depicting an expanded view of the system of FIG. 1.

FIG. 2 is a block diagram depicting an expanded view 200 of the system 100 of FIG. 1. Process ship 102 includes a processing and control system 202 coupled to harvesting unit 110 and is adapted to control movement of the harvesting unit 110. Further, processing and control system 202 is coupled to conduit 114 for receiving methane from clathrate hydrate 108 on the underwater surface 106. System 100 further includes one or more storage tanks 204 connected to processing and control system 202 for receiving and storing the methane gas. Further, process ship 102 also includes a distribution system 206 connected to storage tanks 204 and configured to be selectively connected to a methane deliver system 208, such as a tanker for carrying the methane gas to a destination. Process ship 102 may also include a power generator 205 configured to receive a portion of the natural gas from processing and control system 202 and to consume the portion of the natural gas to produce power for ship 102.

Harvesting unit 110 includes a plow unit 212 including control systems 214, which is responsive to control signals from processing and control system 202 to control motion of plow unit 212 and operation of harvesting unit 110 in general. Plow unit 212 provides propulsion, controls, pumps, camera/vision/sensors, and power cable connections. Power/data cables 211 carry power and data to plow unit 212. As shown, power/data cables 211 may be coupled to or integral with conduit 114 to carry power and controls signals to plow unit 212. In some instances, control systems 214 may include video capabilities, lights, and circuitry permitting remote inspection and control of harvesting unit 110. Plow unit 212 further includes plow/scraper 216 for breaking up clathrate hydrate 108 and for removing and/or breaking up sediments or surface debris (mud) 210 on top of the clathrate hydrate 108. Plow unit 110 also includes wheels and/or tracks 217 for motion. Plow unit 110 may also include pump 219 coupled to a second conduit 209 for pumping surface debris 210 to ship 102.

Harvesting unit 110 also includes a plow or harrow 220, which is connected to remote-controlled vehicle 212 via a hitch or other attachment 218. Harrow 220 includes discs or blades 112 to cut into the clathrate hydrates 108, breaking some of the ice cages and turning portions of the clathrate hydrate 108 into a slush or slurry. Blades 112 may be dragged through the clathrate hydrate 108 or may be rotated to till or otherwise carve up the clathrate hydrate 108 into small pieces or chunks to produce the slurry. Harrow 220 includes a pump 224 for pumping the slurry through conduit 114 to process ship 102. In an alternative embodiment, conduit 114 may be pressurized to form a vacuum or low-pressure to draw the slurry to the surface 104. Harrow 220 may also include a blade or plow 222 to further scrape the clathrate hydrate 108 and to direct the resulting slurry toward pump 224.

In an example, process ship 102 provides power to and controls operation of harvesting unit 110, causing harvesting unit 110 to traverse the underwater surface 106 to harvest the methane from portions of the clathrate hydrate 108. In one example, process ship 102 controls harvesting unit 110 to selectively remove portions of the deposit, while leaving other portions untouched in order to prevent the surface 106 from shifting or slumping. In this example, processing and control system 202 compresses and off-loads the gas to methane deliver system 208, which may be a tanker. Processing and control system 202 separates the gas from surface material, debris, and water, and deposits the debris and surface material outside of the production slopes.

During operation, as the slurry or slush travels upward through conduit 114, slush hydrate reverts to methane gas and water as the temperature increases and the pressure decreases. Conduit 114 may be coupled to one or more separators, such as slurry separator 116 to remove most of the debris before the slurry reaches surface 104.

In general, harvesting unit 110 is a remote-controlled robotic system that is controlled from ship 102, which can be located at surface 104 above the area being harvested. Plow unit 212 uses plow 216 to remove surface material and a pump 219 to pump surface material away from plow unit for re-depositing outside of the production slope. Plow unit 212 includes propulsion, controls, pumps, camera/vision/sensors, and power cable connections to ship 102, allowing for remote control of the robotic system. A power cable 211 delivers power from ship 102 to plow unit 212, which may distribute some power to harrow 220 to provide power to pump 224 and optionally to a motor (not shown) configured to turn blades 112.

Harrow 220 is drawn behind the plow unit 212 and is engaged when the surface layer is removed and the clathrates exposed. Harrow 220 cuts up the clathrate, turning the clathrate into a slurry to be scooped by plow 222 and pumped by pump 224 to ship 102 through conduit 114, which may be a hose. As the pressure on the slurry decreases as it travels up conduit 114, the clathrate changes state. At ship 102, a bi-phasic flow of water and gas is received. Ship 102 uses processing and control system 202 to process and compress the natural gas and to store the gas in storage tank 204 and/or distribute the gas through distribution system 206 to methane delivery system 208, such as a nearby tanker. The water is separated from the gas and discharged back to the ocean. In some instances, at least a portion of the gas may be siphoned off to fuel a power generator on ship 102.

Figure 3:
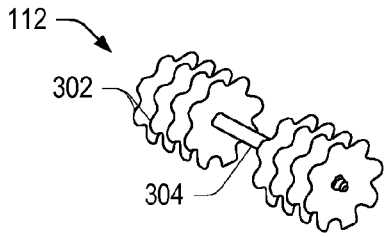
FIG. 3 is a perspective view of an embodiment of blades of a harrow for use within the clathrate hydrate harvesting unit of FIG. 1.

FIG. 3 is a perspective view of an embodiment of the blades 112 of harrow 220 for use within the clathrate hydrate harvesting unit 110 of FIG. 1. Blades 112 include a plurality of discs 302 spaced apart along an axis 304 in a substantially parallel configuration.

The configuration of discs 302 depicted in FIG. 3 represents one possible example of the arrangement of discs. In other embodiments, such discs 304 may include spikes and/or serrated edges to assist in breaking up the clathrate. Further, such discs 304 may be arranged at angles relative to one another to break the clathrate into chunks in order to facilitate slurry formation.

In some instances, harvesting of the clathrate material may threaten to destabilize the underwater surface, resulting in slumping and underwater mudslides that may cover the remaining clathrate and that may cause damage to the harvesting unit 110. The link between seafloor failure and gas hydrate destabilization is a well-established phenomenon, particularly in relation to previous glacial-interglacial local and large-scale sea-level changes. Slope failure can be considered to pose a significant hazard to underwater installations, pipelines and cables, and, in extreme cases, to coastal populations through the generation of tsunamis. One technique for mining coastal clathrate deposits while preventing such slope failure (sometimes referred to as "slumping") is described below with respect to FIG. 4.

Figure 4:
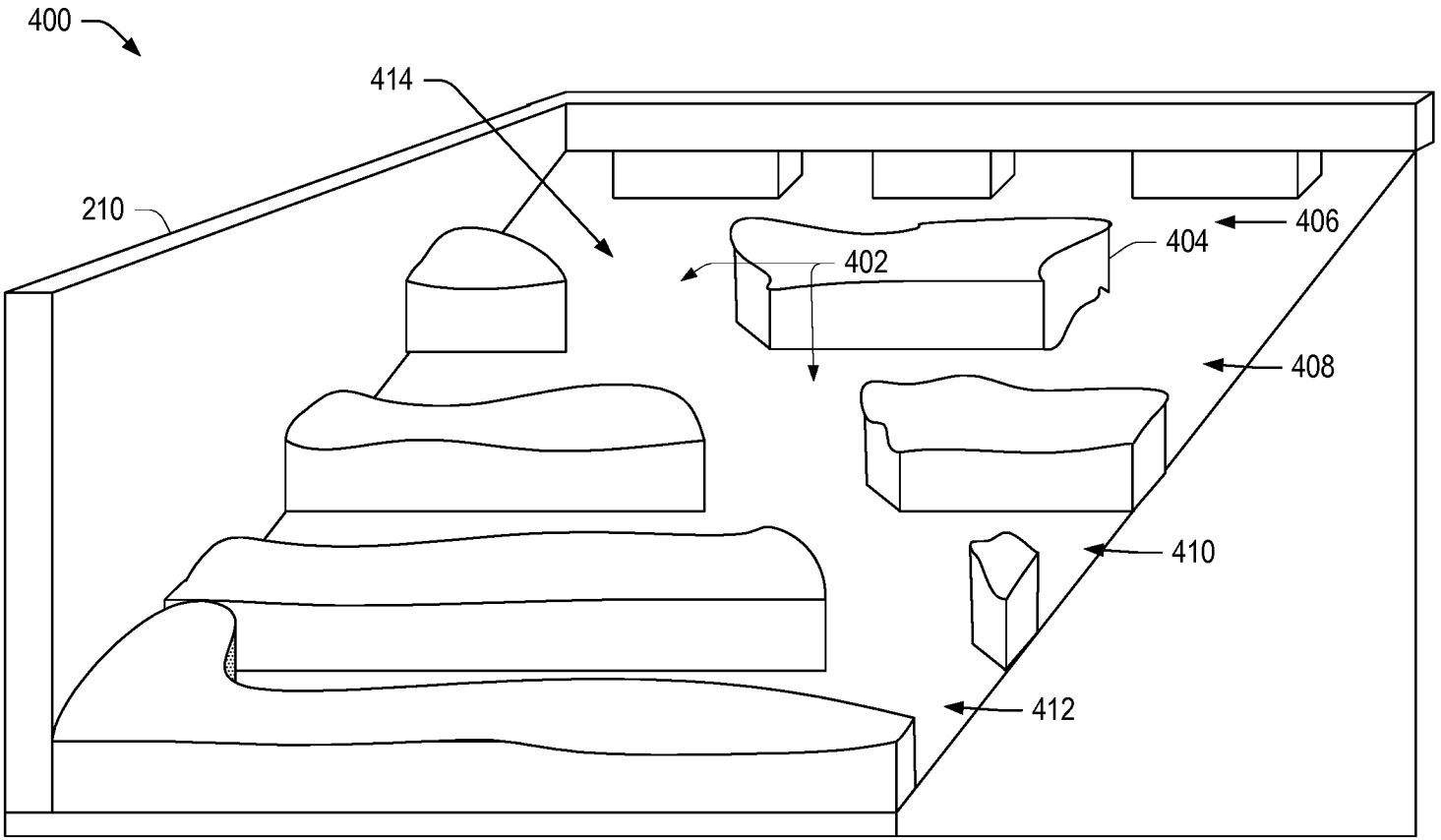
FIG. 4 is a perspective view of an example of a clathrate deposit after harvesting, where pillars of clathrate are left in situ to prevent slumping.

FIG. 4 is a perspective view 400 of an example of a methane clathrate deposit 108 after harvesting, where pillars 404 of methane clathrate 108 are left in situ to prevent slumping. This technique may be similar to rock and pillar coal mining (sometimes referred to as "room-and-pillar" or "step-room and pillar" mining), which operates to secure untouched areas to prevent collapse. In classic room-and-pillar mining, roadways for ore transport and communication are established inside production stopes. Excavation of roadways can be combined with production and mined out stopes can serve as transport routes. Though conduit 114 provides the transport mechanism for the mined clathrate deposit material, pillars can be selectively mined horizontally, vertically, and/or diagonally along the slope in the same fashion as transport routes in classic room-and-pillar mining.

By applying the technique to the clathrate deposit, sea floor shifting or slumping can be mitigated. During harvesting (excavation), upper layers are removed first, leaving pillars 404 to reinforce the seafloor. Harvested portions, generally indicated at 402, are cut up to form the slurry and pumped to ship 102 through conduit 114 using harvesting unit 110 as discussed above.

Portions of the clathrate may be selectively removed, leaving larger pillars to secure less stable portions of the sea floor. Further, a layer of clathrate may be left unprocessed to prevent the slope from shifting. In a particular example, the harvesting process may proceed from an upper level (indicated at 406) to lower levels 408, 410, and 412 for example. A diagonal path is depicted at 414 to facilitate movement of harvesting unit 110.

Figure 5:
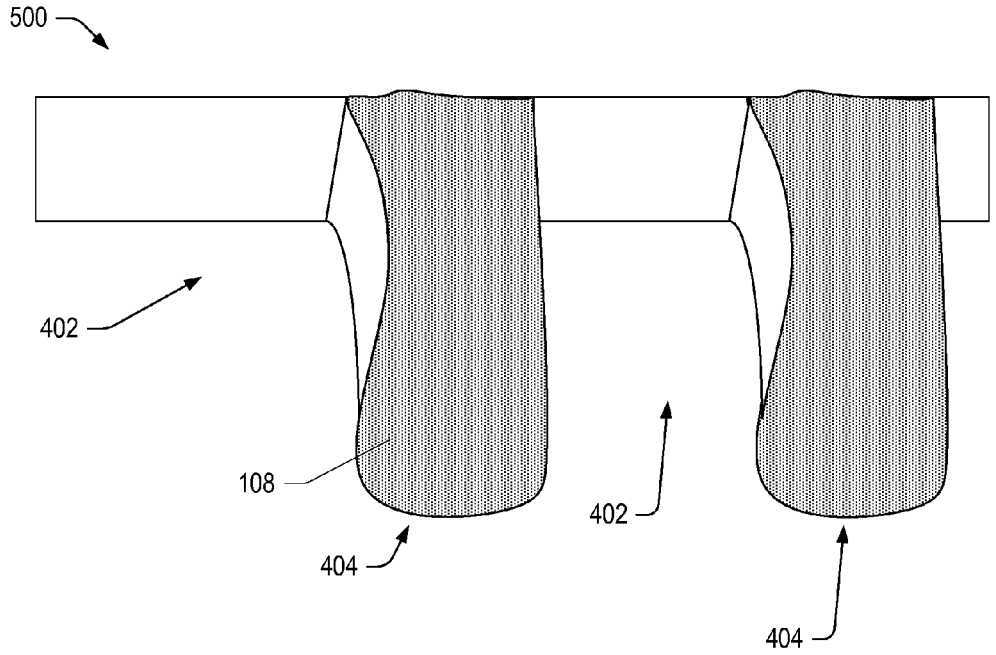
FIG. 5 is a perspective view of another example of a clathrate deposit after harvesting, where pillars of clathrate are left in situ to prevent slumping.

FIG. 5 is a perspective view 500 of another example of a methane clathrate deposit 108 after harvesting, where pillars 404 of methane clathrate 108 are left in situ (untouched) to prevent slumping. Harvesting unit 110 is controlled to extract portions 402 of the methane clathrate deposit 108, leaving pillars 404 untouched to provide support for the seafloor slope to prevent slope failure.

In this instance, pillars 404 may be configured along the slope or across the slope (as shown in FIG. 4), depending on the stability of the sea floor. In this example, pillars 404 are tapered along the slope, where shallower cuts or harvested areas 402 are provided in less stable areas of the sea floor to provide reinforcement. An example of a harvested deposit with pillars 404 extending along the slope is described below in FIG. 6.

Figure 6:
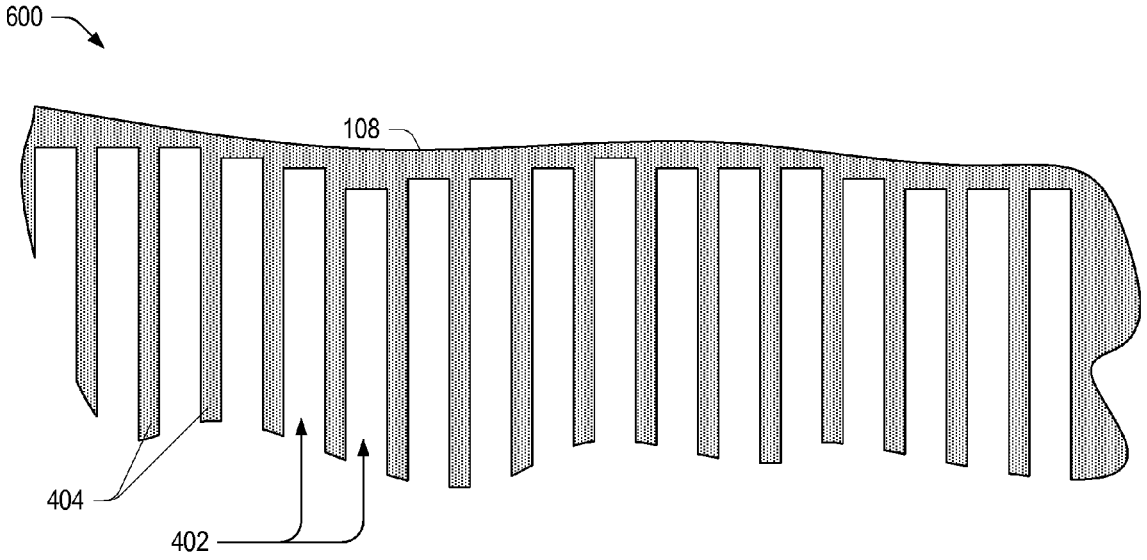
FIG. 6 is a top view of an example of the clathrate deposit of FIG. 5 after harvesting and leaving pillars to prevent slumping.

FIG. 6 is a top view 600 of an example of a clathrate deposit 108 after harvesting leaving pillars 404 to prevent slumping. In this example, pillars 404 surround harvested areas 402 in a comb-like configuration with the pillars 404 extending along the length of the slope to prevent slope failure. Another possible technique for mining the clathrate deposit 108 with slope reinforcing pillars is described below with respect to FIG. 7.

Figure 7:
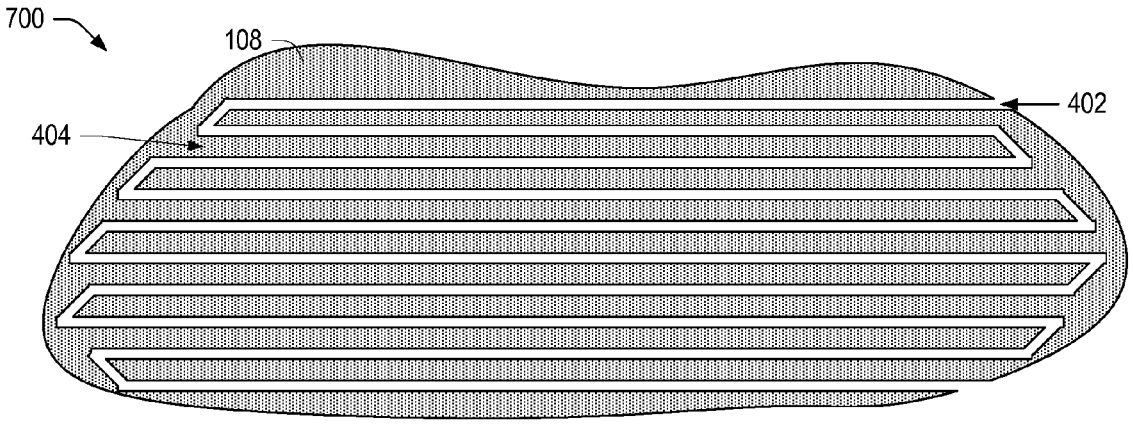
FIG. 7 is a top view of an alternative example of a clathrate deposit after harvesting, using a technique leaving untouched, stable sections to prevent slumping.

FIG. 7 is a top view 700 of an alternative example of a clathrate deposit 108 after harvesting, using a technique leaving untouched, stable sections to prevent slumping. View 700 depicts harvested portions 402 that extend through the clathrate 108 in a serpentine fashion, leaving untouched pillars 404 between the harvested sections. In this example, the harvested portions 402 extend across the slope of the sea floor. In some instances, a diagonal area may be carved out of the clathrate 108 connecting one or more sections of the portions 402 (as depicted in FIG. 4 with respect to diagonal 414).

It should be appreciated that other harvesting techniques may be applied that leave selected portions of clathrate 108 untouched to preserve the slope of the sea floor. By utilizing the clathrate deposit to secure the sea floor, slumping or shifting of the sea floor is prevented as the clathrate 108 is harvested. Pillars 404 may be vertical, diagonal, horizontal, or any combination thereof relative to the slope. Further, in some instances, the pillars 404 may be partially harvested leaving untouched portions of varying thickness and depth, depending on the depth excavated. Additionally, the configuration of pillars 404 may be selected to resist current flows that might otherwise destabilize the sea floor in the area being harvested.

Figure 8:
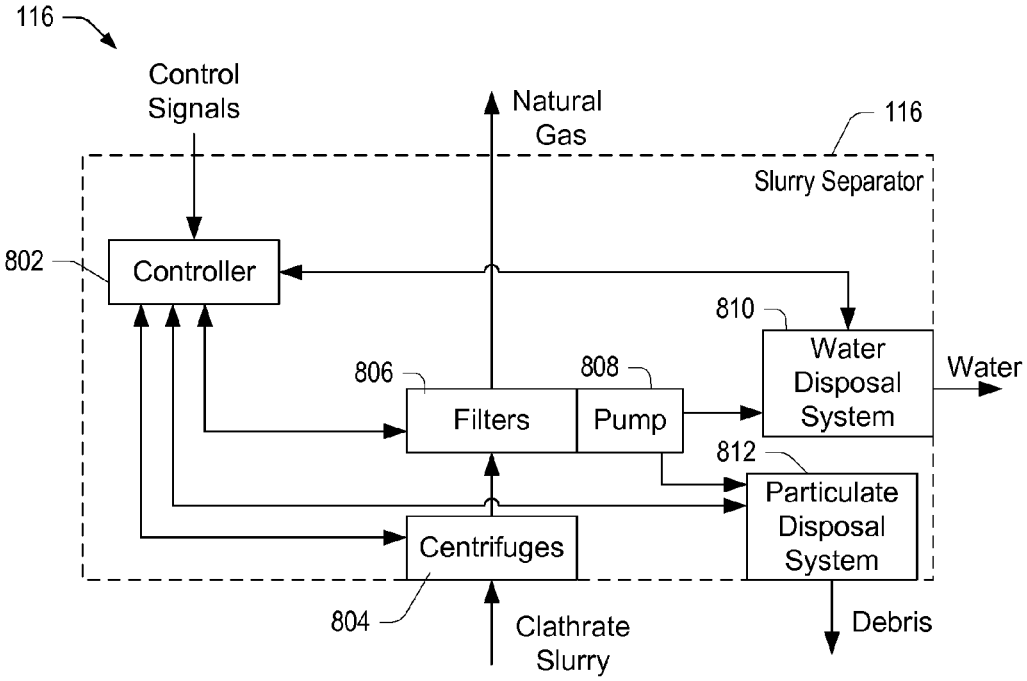
FIG. 8 is a block diagram of a slurry separator portion of the system of FIG. 1.

FIG. 8 is a block diagram of a slurry separator 116 of the system of FIG. 1. In this instance, slurry separator 116 may be coupled to power/data cables 211 for receiving control signals and power from ship 102. Slurry separator 116 includes a controller 802 coupled to the power/data cables 211. Slurry separator 116 also includes one or more centrifuges 804 or other processing means for processing the slurry to remove debris and to separate the natural gas from the slurry. The one or more centrifuges 804 are connected to filters 806, which filter the debris from the composition. Filters 806 are connected to pump 808 for pumping water through water disposal system 810, which may be a pipe or tube for distributing the water back into the ocean away from the harvesting location. Pump 808 may also pump the debris through particulate disposal system 812 for returning the debris the sea floor at a location that is removed from the clathrate deposit 108. Filters 806 also allow the natural gas that is freed from the clathrate slurry to continue through the conduit 114.

If the slurry separator 116 is connected to the conduit 114 between the harvesting unit 110 and the ship 102, slurry separator 116 receives power and control signals from the power/data cables 211. Alternatively, slurry separator 116 may be included within the processing and control system 202 (depicted in FIG. 2). In this instance, control systems and power generator 205 may be coupled to the slurry separator within the ship 102 via separate control and power lines.

In an alternative embodiment, grinding elements may be used in addition to or in lieu of centrifuges 804 to further break down the slurry into its component elements and to separate the natural gas from the slurry. Further, other processing means, such as heating, may be used to facilitate the separation process.

Figure 9:
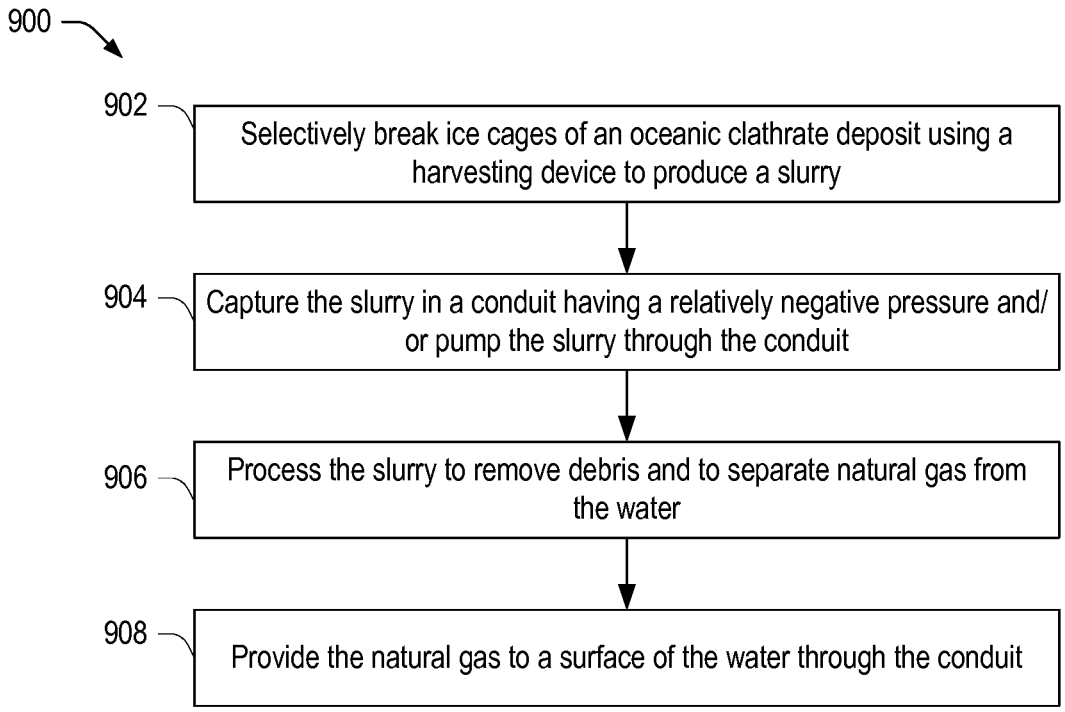
FIG. 9 is a flow diagram of an embodiment of a method of harvesting natural gas from an underwater clathrate deposit.

FIG. 9 is a flow diagram of an embodiment of a method 900 of harvesting methane clathrate from an underwater deposit. At 902, a harvesting unit is used to selectively break ice cages of an oceanic clathrate deposit to produce a slurry. In an example, the harvesting unit may remove a surface layer of debris to expose the clathrate 108. To break the ice cages, harvesting unit cuts or otherwise breaks up the clathrate 108 into pieces to form the slurry.

Advancing to 904, the harvesting unit captures the slurry in a conduit having a relatively negative pressure and/or pumps the slurry through the conduit. In one instance, a suction or vacuum is provided within the conduit to draw the slurry upward toward the surface of the ocean. In another example, the harvesting unit includes a pump for pushing the slurry through the conduit toward the surface.

Moving to 906, the slurry is processed to remove debris and to separate the natural gas from the slurry. The slurry may be processed by a slurry separator that is located between the harvesting unit and a ship along a conduit. Alternatively, the slurry separator may be located within the ship. In still another example, the slurry separator may be included within the harvesting unit for processing the slurry.

Continuing to 908, the natural gas is provided to a surface of the water through the conduit. In an example, the conduit is connected to a processing unit within a ship a the surface for further processing and compressing the natural gas for storage and/or transport as discussed below with respect to FIG. 10.

Figure 10:
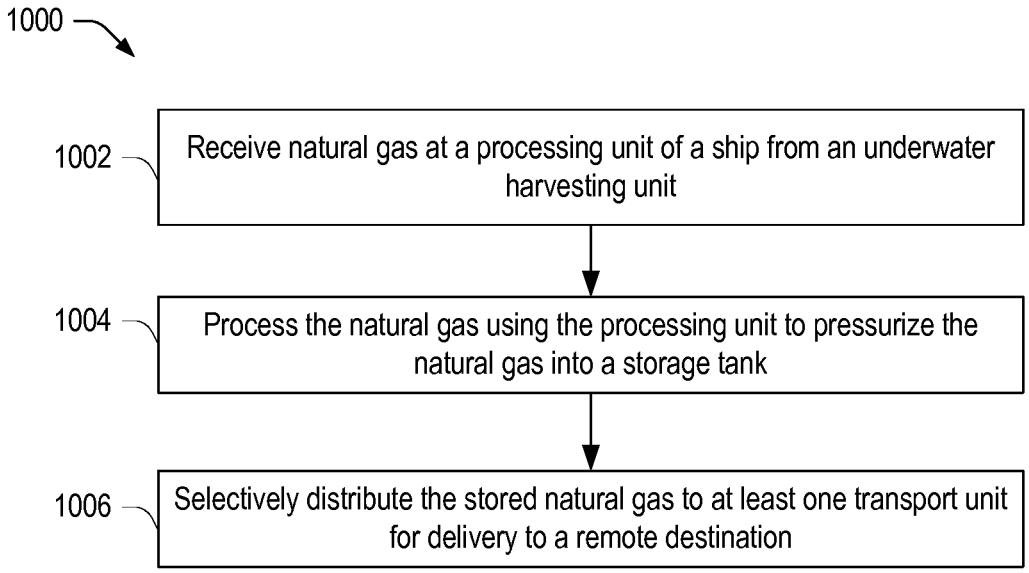
FIG. 10 is a flow diagram of an embodiment of a method of processing natural gas received from a methane clathrate harvesting unit.

FIG. 10 is a flow diagram of an embodiment of a method 1000 of processing methane gas received from a clathrate harvesting unit. At 1002, natural gas is received at a processing unit of a ship from an underwater harvesting unit. In an example, the natural gas flows through a conduit from a slurry separator, which is connected by the conduit to the underwater harvesting unit. In another example, the natural gas flows through the conduit in conjunction with the slurry, which is then processed by a processing unit of the ship.

Advancing to 1004, the natural gas is processed using the processing unit of the ship to pressurize the natural gas into a storage tank. In this instance, the storage tank is part of the ship. Continuing to 1006, the natural gas is selectively distributed to at least one transport unit for delivery to a remote destination. The transport unit may be tanker or other transport vessel.

It should be appreciated that, in some embodiments, the pressurizing of the natural gas may be combined with the selective distribution to the transport unit, making it possible for the ship to provide limited natural gas storage. In some instances, the ship may be concurrently connected to more than one tanker for selective delivery of the natural gas to the tankers, allowing the ship to have no natural gas storage capabilities or limited capabilities apart from the processing unit itself.

Figure 11:
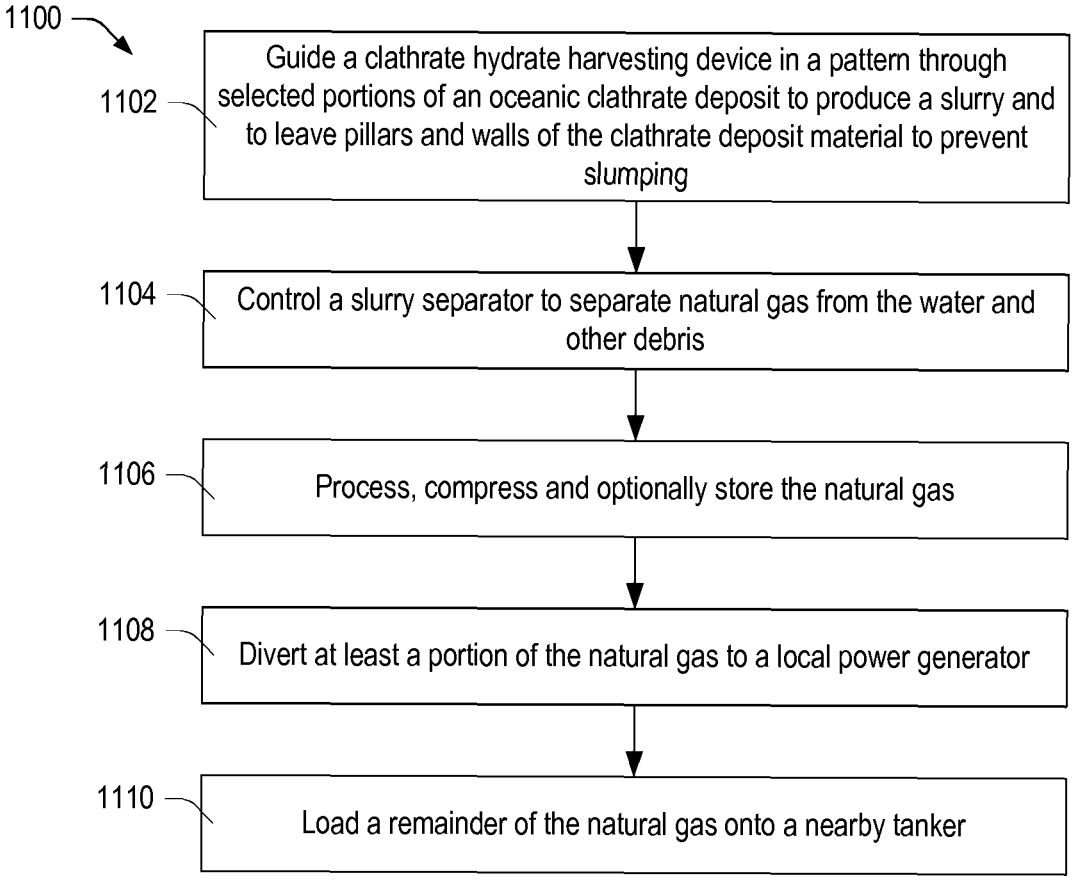
FIG. 11 is a flow diagram of an embodiment of a method of harvesting natural gas from an underwater clathrate deposit and distributing the natural gas to nearby tankers.

FIG. 11 is a flow diagram of an embodiment of a method 1100 of harvesting natural gas from clathrate and distributing the resulting natural gas to nearby tankers. At 1102, a clathrate hydrate harvesting device is controlled or guided in a pattern through selected portions of an oceanic clathrate deposit to produce a slurry and to leave pillars and walls of the clathrate deposit material to prevent slumping, particularly slumping or shifting of the sea floor in the area of the deposit. As discussed above with respect to FIGS. 4-7, various patterns may be employed including rows, pillars, tapered pillars, a serpentine pattern, diagonals, and other patterns depending on the underlying stability of the sea floor, the grade or slope of the harvesting area, underwater currents, and other factors. The harvesting unit can be guided by a control system aboard the ship.

Advancing to 1104, a slurry separator is controlled to separate the natural gas from the water and other debris. In some instances, the slurry separator is remotely controlled by a control system on board the ship. Alternatively, the slurry separator is located on the ship and controlled manually or through control signals sent using the onboard control systems.

Continuing to 1106, a processing unit on board the ship processes, compresses, and optionally stores the natural gas. Moving to 1108, at least a portion of the natural gas is diverted to a local power generator on board the ship to provide power to the various systems. Proceeding to 1110, a remainder of the natural gas is loaded onto a nearby tanker for delivery to a remote destination.

In conjunction with the systems and methods described above with respect to FIGS. 1-11, a system for recovering natural gas, such as methane, from oceanic deposits is disclosed that includes an underwater harvesting unit configured to expose a clathrate deposit and to mechanically break up selected portions of the clathrate deposit to produce a slurry that is pumped toward a ship located at the surface of the water. A slurry separator (either located along the conduit or within the ship) processes the slurry to separate the natural gas from the slurry. The natural gas is further processed and compressed for delivery to a nearby tanker.

In a particular example, a controller onboard the ship controls the operation and movement of the underwater harvesting unit to selectively harvest portions of the clathrate, leaving pillars and/or untouched areas to prevent undesired shifting or slumping of the ocean floor. In some instances, the pillars may be selectively harvested, leaving tapered portions having a thickness that varies according to the relative stability of the ocean floor. In a particular instance, the pillars may extend vertically, horizontally, diagonally, or any combination thereof relative to the slope of the ocean floor. The particular configuration may be selected based on the thickness of the clathrate, the grade of the slope, the oceanic currents, or any combination thereof.

Although the present invention has been described with reference to preferred embodiments, workers skilled in the art will recognize that changes may be made in form and detail without departing from the scope of the invention.

What is claimed is:

1. A system for harvesting natural gas from a clathrate hydrate deposit, the system comprising:

a storage system at a surface of a body of water, the storage system configurable to couple to a conduit to receive natural gas from an underwater apparatus;

a processing system coupled to the conduit and configured to separate the natural gas from a slurry including clathrate hydrate pieces and the natural gas; and the underwater apparatus including:

a plow unit including a propulsion system responsive to control signals to move the plow unit and including a scraper to remove surface material on top of the clathrate hydrate deposit to expose the clathrate hydrate deposit;

a first pump coupled to a particulate disposal system configured to pump surface material away from the plow unit to an area outside of a production slope;

a harrow unit to break up the clathrate hydrate deposit to produce the slurry; and a second pump to provide the slurry to the processing system.

2. The system of claim 1, further comprising a control system coupled to the underwater apparatus via a cable, the control system to control operation of the underwater apparatus.

3. The system of claim 2, wherein the control system provides control signals to the propulsion system to control movement of the underwater apparatus to mechanically fracture and dislodge selected portions of the clathrate hydrate deposit to produce the slurry.

4. The system of claim 3, wherein the control system controls the underwater apparatus to selectively harvest portions of the clathrate hydrate deposit while leaving pillars to prevent shifting of an underwater surface.

5. The system of claim 1, further comprising a distribution system configured to releasably couple to a tanker, the distribution system to provide the natural gas to the tanker.

6. The system of claim 1, further comprising a slurry separator configured to separate the natural gas from the slurry and to discharge debris and water to a location removed from an area associated with the underwater apparatus.

7. The system of claim 1, wherein the processing system and the conduit cooperate to apply a slight negative pressure and to separate the natural gas from the slurry and to control flow of the natural gas to the storage system.

8. A harvesting unit comprising:

a plow unit including a propulsion system and configured to move along an underwater surface according to control signals from a remote controller, the plow unit including:

a scraper configured to remove surface material on top of a clathrate deposit to expose the clathrate deposit;

a first pump coupled to a particulate disposal system configured to pump surface material away from the plow unit to an area outside of a production slope;

a harrow coupled to the plow unit to follow behind the plow unit, the harrow configured to couple to a conduit, to mechanically break portions of the clathrate deposit into a slurry, and to direct the slurry into the conduit; and a second pump proximate to the harrow and adapted to provide a negative pressure to the conduit to draw the slurry into the conduit.

9. The harvesting unit of claim 8, further comprising a second pump coupled to one of the harrow and the conduit, the second pump to push the slurry into the conduit.

10. The harvesting unit of claim 8, wherein the harrow comprises a plurality of discs for mechanically fracturing the clathrate deposit and for dislodging portions of the clathrate deposit to produce the slurry.

11. The harvesting unit of claim 8, wherein the harrow comprises a plurality of elements configured to fracture and dislodge portions of the clathrate deposit.

12. The harvesting unit of claim 8, wherein the conduit applies a relative vacuum for capturing the slurry.

13. The harvesting unit of claim 12, wherein the harrow further comprises a plow element configured to direct the slurry toward the conduit.

14. The harvesting unit of claim 8, wherein the plow unit includes a controller for controlling the propulsion system in response to the control signals from the remote controller.

15. A method of harvesting natural gas from clathrate hydrate deposits on an underwater surface, the method comprising:

removing surface material to expose the clathrate hydrate deposit using a scraper of a mobile harvesting unit;

pumping surface material to a particulate disposal system configured to direct the surface away from the mobile harvesting unit to an area outside of a production slope using a first pump of the mobile harvesting unit;

mechanically fracturing and dislodging selected portions of the clathrate hydrate deposit from the underwater surface using a harrow of the mobile harvesting unit;

directing the selected portions into a conduit as a slurry using a second pump of the mobile harvesting unit; and processing the slurry to separate natural gas from other components, the conduit to direct the natural gas to a storage system at a surface of the water.

16. The method of claim 15, wherein mechanically fracturing and dislodging selected portions comprises:

controlling the mobile harvesting unit to fracture and dislodge the selected portions of the clathrate hydrate deposit according to a pattern; and controlling the mobile harvesting unit to leave other portions of the clathrate hydrate deposit to secure a slope of the underwater surface.

17. The method of claim 16, wherein the pattern comprises a plurality of pillars sized based on a stability of the underwater surface and in a direction relative to the slope of the underwater surface and relative to underwater currents to limit shifting of the underwater surface.

18. The method of claim 15, further comprising:

distributing the natural gas to one or more tankers; and discharging the other components of the slurry to a location that is removed from the underwater surface associated with the clathrate hydrate deposit.

19. The method of claim 15, wherein directing the selected portions into the conduit comprises at least one of pumping the selected portions into the conduit and pressurizing the conduit to provide a relatively low pressure for drawing the selected portions into the conduit.

* * * * *